US007219428B2

(12) United States Patent
Ito

(10) Patent No.: US 7,219,428 B2
(45) Date of Patent: May 22, 2007

(54) METHOD OF PRODUCING AN INK-JET PRINTING HEAD

(75) Inventor: Atsushi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 261 days.

(21) Appl. No.: 10/940,913

(22) Filed: Sep. 14, 2004

(65) Prior Publication Data

US 2005/0068380 A1 Mar. 31, 2005

(30) Foreign Application Priority Data

Sep. 26, 2003 (JP) ..... 2003-335222

(51) Int. Cl.
*B21D 53/76* (2006.01)
*B41J 2/045* (2006.01)

(52) U.S. Cl. ..... 29/890.1; 29/25.35; 29/830; 29/831; 29/832; 347/68

(58) Field of Classification Search ..... 29/25.35, 29/890.1, 830, 832, 843, 945, 845; 347/68–72, 347/291.9, 292
See application file for complete search history.

(56) References Cited

U.S. PATENT DOCUMENTS 5,402,159 A * 3/1995 Takahashi et al. ..... 347/9
5,956,059 A * 9/1999 Usui ..... 347/71
5,963,234 A * 10/1999 Miyazawa et al. ..... 347/70
6,033,058 A * 3/2000 Usui et al. ..... 347/71
6,134,761 A * 10/2000 Usui ..... 29/25.35
2003/0067510 A1 4/2003 Isono

FOREIGN PATENT DOCUMENTS

JP 2003-112423 4/2003

* cited by examiner

*Primary Examiner*—A. Dexter Tugbang
*Assistant Examiner*—Tai Van Nguyen
(74) *Attorney, Agent, or Firm*—Reed Smith LLP

(57) ABSTRACT

A method of producing an ink-jet printing head, the method including: forming a pre-unit in which nozzles and a common ink chamber are formed; forming pressure chambers in a cavity plate through its thickness; forming a piezoelectric actuator by stacking piezoelectric sheets each having a size substantially covering the pressure chambers, with at least one electrode being interposed between adjacent two of the sheets; a step of forming an integral body by stacking and bonding the actuator and the cavity plate such that one of opposite openings of each of the pressure chambers is closed by the actuator; and a step of bonding the integral body to the pre-unit, such that the pressure chambers respectively communicate with the nozzles and the at least one common ink chamber and such that the other of the opposite openings of each of the pressure chambers is closed by the pre-unit.

8 Claims, 7 Drawing Sheets

METHOD OF PRODUCING AN INK-JET PRINTING HEAD

The present application is based on Japanese Patent Application No. 2003-335222 filed Sep. 26, 2003, the contents of which are incorporated herein by reference.

BACKGROUND OF THE INVENTION

1. Field of the Invention

The present invention relates in general to a method of producing an ink-jet printing head wherein a piezoelectric actuator having a plurality of electrodes is bonded to a cavity plate in which a plurality of pressure chambers are formed, such that the electrodes respectively correspond to the pressure chambers with high accuracy. The invention also relates to an ink-jet printing head produced by the method.

2. Discussion of Related Art

There is known an on-demand piezoelectric type ink-jet printing head as disclosed in JP-A-2003-112423, for instance, which includes a cavity unit having a plurality of nozzles and a plurality of pressure chambers respectively corresponding to the nozzles, and a sheet-stacked type piezoelectric actuator having a plurality of active portions respectively corresponding to the pressure chambers, and a flexible flat cable for supplying an electric power to the piezoelectric actuator.

The cavity unit described above includes a nozzle plate in which the nozzles are formed through the thickness thereof, a cavity plate in which the pressure chambers are formed, and other plates in which common ink chambers, etc., are formed, which plates are stacked on and bonded to one another. The piezoelectric actuator is formed of piezoelectric sheets each having individual electrodes formed on the surface thereof and piezoelectric sheets each having common electrodes which are formed on the surface thereof and which are common to the plurality of pressure chambers, the piezoelectric sheets being stacked on and bonded to one another. In the thus formed piezoelectric actuator, portions of the piezoelectric sheets sandwiched by and between the individual electrodes and the common electrodes function as active portions.

The piezoelectric actuator formed as described above is superposed on and bonded to the cavity unit such that the active portions respectively correspond to the pressure chambers. Further, the flexible flat cable is superposed on and bonded to the piezoelectric actuator to which the cavity unit has been bonded, so that the flexible flat cable selectively supplies an electric power to the individual electrodes of the piezoelectric actuator. In the thus formed ink-jet printing head, the electric power is supplied to an arbitrary active portion of the piezoelectric actuator to deform (i.e., contract or expand) the same, to thereby deform the corresponding pressure chamber by the deformation of the active portion, so that the ink is ejected from the corresponding nozzle.

Accordingly, the ink ejecting performance of the ink-jet printing head is adversely influenced unless the piezoelectric actuator and the cavity unit are bonded with high accuracy such that the active portions and the pressure chambers are accurately aligned with each other. Therefore, in stacking and bonding the piezoelectric actuator and the cavity unit, they need to be positioned relative to each other with high accuracy. As a result, the ink-jet printing head may undesirably suffer from a high defective ratio due to positioning error.

Even if suitable positioning marks indicating the position of the individual electrodes are provided on the pre-sintered piezoelectric sheets for positioning the piezoelectric actuator and the cavity unit relative to each other, the locations of the positioning marks are offset from the original or nominal locations after sintering of the piezoelectric sheets since the piezoelectric sheets contract or shrink by sintering and the amount of contraction or shrinkage varies depending upon the individual piezoelectric sheets. This makes the accurate positioning difficult. In view of the above, in the above-described Publication (JP-A-2003-112423), the piezoelectric actuator and the cavity unit are positioned relative to each other by utilizing detect portions which are provided on the appropriate piezoelectric sheets such that they can be detected by irradiation of a light, and positioning marks formed on the cavity plate of the cavity unit. Described more specifically, the center of gravity P of the piezoelectric actuator is obtained from shadows of the detect portions by an image processing device while the center of gravity Q of the cavity unit is obtained from images of the positioning marks taken by an image taking device. The piezoelectric actuator and the cavity unit are positioned relative to each other such that the centers of gravity P, Q are aligned with each other, and then bonded and fixed to each other. According to the technique disclosed in the Publication, the piezoelectric actuator and the cavity unit can be accurately positioned relative to each other by obtaining the center of gravity of the piezoelectric actuator after sintering even if the amount of contraction varies.

As explained above, it is very important, in producing the ink-jet printing head, to accurately position the active portions and the pressure chambers relative to each other. Accordingly, if an integral body obtained in a bonding step of bonding the piezoelectric actuator and the cavity unit is found defective due to the positioning error, for instance, the integral body is removed from the production line without being forwarded to following steps conducted after the bonding step. In this case, the cavity unit is wastefully discarded due to poor bonding between the piezoelectric actuator and the cavity unit which arises from the inaccurate alignment of the active portions and the pressure chambers even if the plates (such as the nozzle plates) other than the cavity plate having the pressure chambers have no defects and the stacked structure of the cavity unit has no defects. This undesirably wastes the cost of components (plates) and the step of stacking the plates for forming the cavity unit results in vain.

Even if the piezoelectric actuator and the cavity unit are accurately positioned relative to each other immediately before bonding, the misalignment may be caused when the piezoelectric actuator and the cavity unit are pressed against each other when they are actually bonded. In the technique disclosed by the above-described Publication, however, it is impossible to project the detect portions on the image processing device once the piezoelectric actuator is superposed on and bonded to the upper surface of the cavity unit. Hence, the conventional technique suffers from a problem that it is impossible to confirm, after bonding, whether the piezoelectric actuator and the cavity unit are accurately positioned relative to each other.

SUMMARY OF THE INVENTION

It is therefore a first object of the present invention to provide a method of producing an ink-jet printing head wherein, in bonding a piezoelectric actuator having active portions and a cavity plate having pressure chambers, the active portions and the pressure chambers can be easily and accurately positioned relative to each other while making it possible to prevent the cost of components from being wasted even if some defects due to positioning error, for instance, are found after bonding of the piezoelectric actuator and the cavity plate. It is a second object of the invention to provide an ink-jet printing head produced by the method.

The first object indicated above may be achieved according to a first aspect of the present invention, which provides a method of producing an ink-jet printing head which includes a plurality of nozzles, a plurality of pressure chambers which respectively correspond to the plurality of nozzles, at least one common ink chamber from which ink is supplied to the plurality of pressure chambers, a piezoelectric actuator which includes a plurality of active portions respectively corresponding to the plurality of pressure chambers, the method comprising the steps of: a pre-unit forming step of forming a pre-unit in which the plurality of nozzles and the at least one common ink chamber are formed; a pressure-chamber forming step of forming the plurality of pressure chambers in a cavity plate through the thickness thereof; a piezoelectric-actuator forming step of forming the piezoelectric actuator by stacking a plurality of piezoelectric sheets each having a size substantially covering the plurality of pressure chambers, with at least one electrode being interposed between adjacent two of the plurality of piezoelectric sheets, so that portions of the plurality of piezoelectric sheets sandwiched by the electrodes function as the plurality of active portions; an integral-body forming step of forming an integral body including the plurality of pressure chambers by stacking and bonding the piezoelectric actuator and the cavity plate such that the plurality of active portions respectively correspond to the plurality of pressure chambers and such that one of opposite openings of each of the plurality of pressure chambers is closed by the piezoelectric actuator; and an integral-body bonding step of bonding the integral body which includes the plurality of pressure chambers to the pre-unit, such that the plurality of pressure chambers respectively communicate with the plurality of nozzles and the at least one common ink chamber and such that the other of the opposite openings of each of the plurality of pressure chambers is closed by the pre-unit.

In the method according to the above-described first aspect of the present invention, the cavity plate in which the pressure chambers are formed and the piezoelectric actuator having the active portions are bonded to each other to provide the integral body. Thereafter, the pre-unit having the nozzles and the at least one common ink chambers is bonded to the integral body including the pressure chambers. Since the cavity plate and the piezoelectric actuator need to be positioned relative to each other with high or strict accuracy such that the pressure chambers are properly aligned with the respective active portions. Accordingly, the integral body may suffer from a high defective ratio due to improper alignment of the pressure chambers with the active portions. In the present method, however, even if the integral body obtained in the integral-body forming step wherein the actuator and the cavity plate are bonded to each other is found defective due to the improper alignment, the pre-unit is not yet bonded to the integral body at this stage. Accordingly, if the defective integral body is removed or taken away from the production line, it is not necessary to discard the pre-unit, favorably preventing the components of the pre-unit from being wasted and minimizing or reducing waste of the cost due to defects.

It is noted that the order of conducting the pre-unit forming step and the integral-body forming step is not particularly limited. It is further noted that the order of conducting the pre-unit forming step, the pressure-chamber forming step and the piezoelectric-actuator forming step is not particularly limited, provided that the integral-body forming step is conducted after the pressure-chamber forming step and the piezoelectric-actuator forming step.

The second object indicated above may be achieved according to a second aspect of the present invention, which provides an ink-jet printing head comprising an integral body consisting of a piezoelectric actuator and a cavity plate, the piezoelectric actuator of the integral body including a plurality of piezoelectric sheets and a plurality of electrodes each of which is formed so as to be interposed between adjacent two of the plurality of piezoelectric sheets, portions of the plurality of piezoelectric sheets which are sandwiched by the electrodes functioning as a plurality of active portions, the cavity plate of the integral body including a plurality of pressure chambers which are formed through the thickness thereof and which respectively correspond to the plurality of active portions, the cavity plate being stacked on and bonded to the piezoelectric actuator at one of opposite surfaces thereof, wherein the piezoelectric actuator further includes at least one detect portion which can be perceived from an outside of the piezoelectric actuator and the cavity plate further includes at least one opening which is formed through a thickness thereof, and the piezoelectric actuator and the cavity plate are stacked on and bonded to each other to provide the integral body, such that the entirety of each of the at least one detect portion is located within each of the at least one opening as viewed from a cavity-plate side in a direction of stacking of the piezoelectric actuator and the cavity plate.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
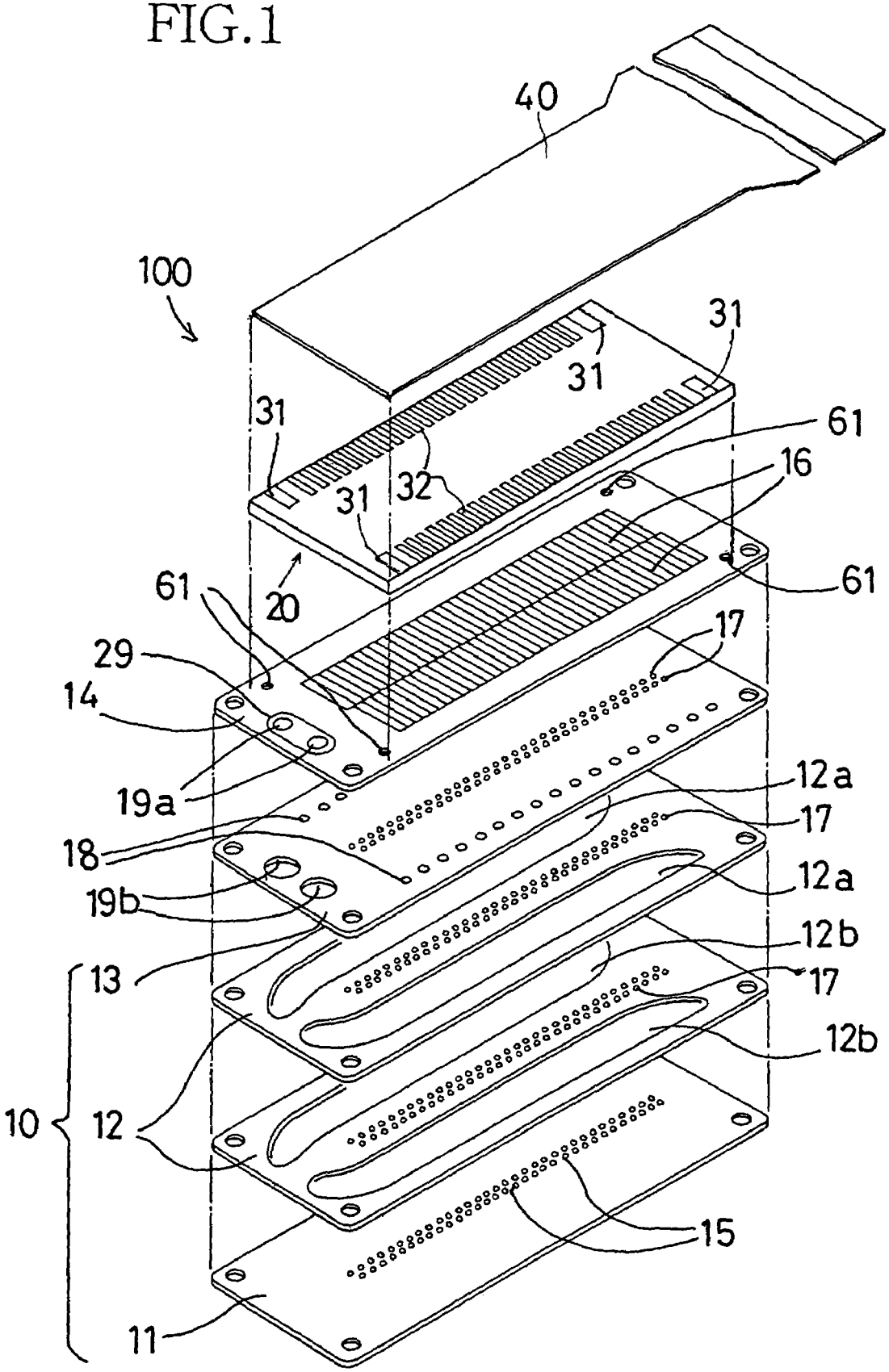
FIG. 1 is an exploded perspective view of a piezoelectric ink-jet printing head to which the present invention is applied.

Referring to the drawings, there will be described preferred embodiments of the present invention.

Referring first to FIG. 1 of the exploded perspective view, there is shown a piezoelectric type ink-jet printing head generally indicated at 100. The present ink-jet printing head 100 includes a sheet-stacked type piezoelectric actuator 20, a cavity plate 14 in which a plurality of pressure chambers 16 are formed and which is bonded to a lower surface (front surface) of the piezoelectric actuator 20, a flexible flat cable 40 which is bonded to an upper surface (back surface) of the piezoelectric actuator 20 for connecting the same 20 to an external device, and a pre-unit 10 which is bonded to a lower surface (front surface) of the cavity plate 14. The ink-jet printing head 100 ejects a droplet of ink in a downward direction from each of ink ejection nozzles 15 which are open in a lower surface of a pre-unit as the lowermost layer of the pre-unit 10.

By referring to FIGS. 1 and 2, there will be described structures of the pre-unit 10 and the cavity plate 14, respectively.

Figure 2:
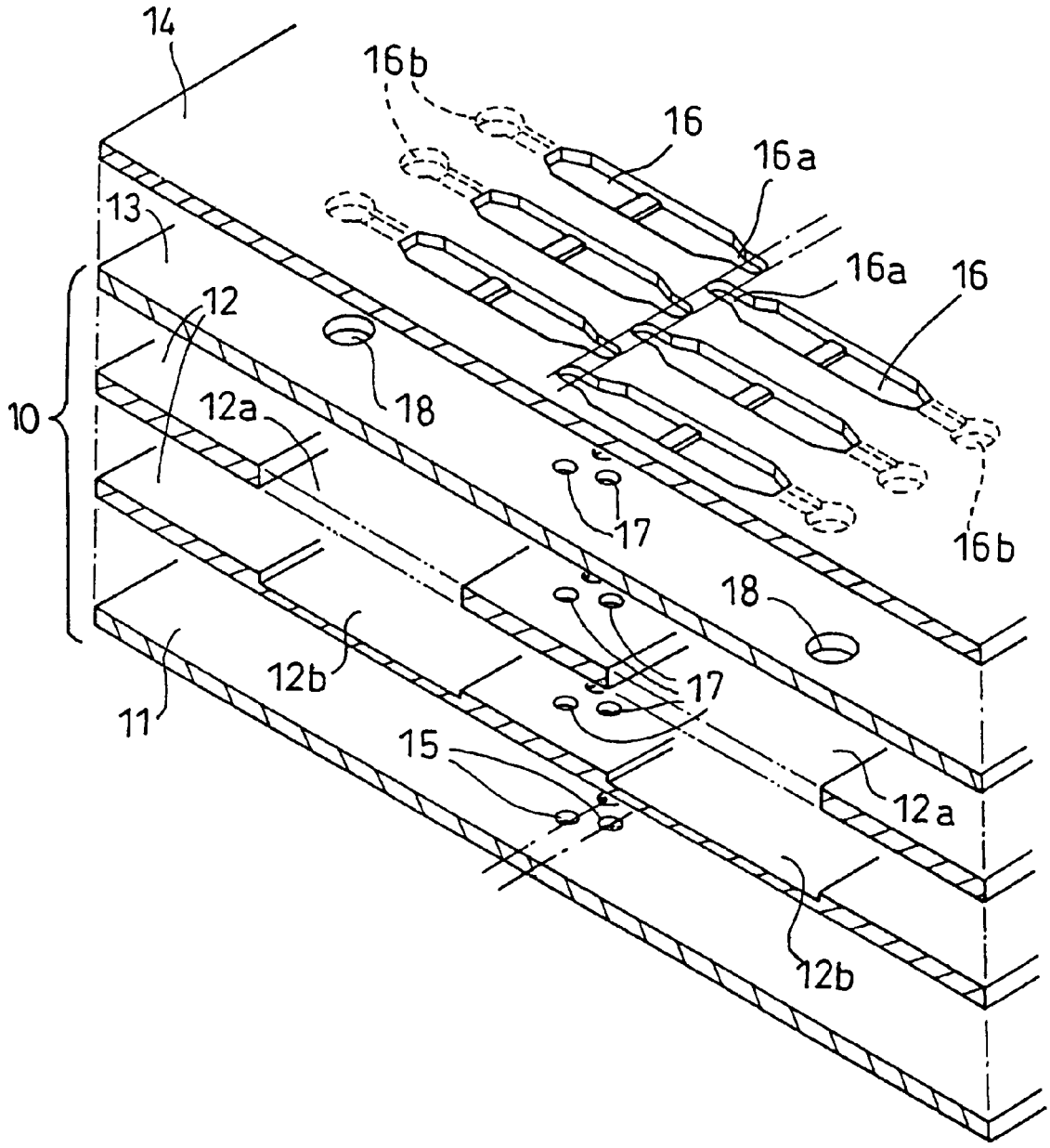
FIG. 2 is a fragmentary enlarged perspective view of a cavity plate and a pre-unit of the printing head.

As shown in FIGS. 1 and 2, the pre-unit 10 consists of four thin plates which are stacked on and bonded to one another with an adhesive. The four plates are a nozzle plate 11, two manifold plates 12, 12, and a spacer plate 13. The cavity plate 14 is also a thin plate. In the present embodiment, the plates 12, 12, 13, 14, except for the nozzle plate 11, are each formed of a 42% nickel alloy steel plate and have respective thickness values each of which falls within a range from about 50 μm to about 150 μm. The nozzle plate 11 is formed of synthetic resin.

The nozzle plate 11 has a multiplicity of ink ejection nozzles 15 each having an extremely small diameter (e.g., about 25 μm in the present embodiment). The nozzles 15 are formed through the thickness of the nozzle plate 11, in two straight rows extending in a first direction (i.e., a longitudinal direction) of the pre-unit 10 or the printing head 100, such that the nozzles 15 of each row are equally spaced apart from each other at a relatively small spacing pitch and such that each of the nozzles 15 of one of the two rows is interposed between the adjacent two nozzles 15 of the other row in the longitudinal direction. Thus, the nozzles 15 are formed in the two rows, in a zigzag or staggered manner.

As shown in FIG. 1, an upper one of the two manifold plates 12, 12 has two manifold openings 12*a*, 12*a* which are formed through the thickness of the upper manifold plate 12 such that the two manifold openings 12*a*, 12*a* extend on opposite sides of the two straight rows of the nozzles 15, respectively, in the longitudinal direction of the pre-unit 10. The lower manifold plate 12 has two manifold recesses 12*b*, 12*b* which are open in only an upper surface thereof, which are respectively aligned with the manifold openings 12*a*, 12*a* of the upper manifold plate 12, and which have the substantially same shape in their plan view as that of the manifold openings 12*a*, 12*a*. Each of the two manifold openings 12*a*, 12*a* cooperates with a corresponding one of the two manifold recesses 12*b*, 12*b* to define a common ink chamber. The two common ink chambers 12*a*, 12*b*; 12*a*, 12*b* are fluid-tightly closed by the spacer plate 13 stacked on the upper manifold plate 12.

As shown in FIG. 1, the cavity plate 14 has two rows of pressure chambers 16 formed through the thickness thereof such that the two rows of pressure chambers 16 extend in the longitudinal direction (first direction) of the pre-unit 10 or the printing head 100 and are arranged in a zigzag fashion in the first direction. Each pressure chamber 16 has an elongate shape which extends in a widthwise direction of the cavity plate 14 that is perpendicular to the longitudinal direction (first direction) of the pre-unit 10 or the printing head 100. The cavity plate 14 is bonded to one of opposite surfaces of the pre-unit 10 remote from the nozzles 15.

As shown in FIG. 2, respective inner ends 16*a* of the pressure chambers 16 are located in a widthwise middle portion of the cavity plate 14 and communicate with the respective nozzles 15 of the nozzle plate 11 via respective small-diameter through-holes 17 that are formed in two rows in a zigzag manner through the thickness of each of the space plate 13 and the two manifold plates 12, 12 of the pre-unit 10. The through-holes 17 provide respective ink channels connecting between the pressure chambers 16 and the corresponding nozzles 15.

On the other hand, respective outer ends 16*b* of the pressure chambers 16 of one of the two rows communicate with a corresponding one of the two common ink chambers 12*a*, 12*b*; 12*a*, 12*b* of the two manifold plates 12, 12 via a corresponding one of two rows of through-holes 18 that are formed through the thickness of the spacer plate 13 such that the two rows of the through-holes 18 are respectively located near opposite long side edges of the spacer plate 13; and respective outer ends 16*b* of the pressure chambers 16 of the other row communicate with the other common ink chamber 12*a*, 12*b* via the other row of through-holes 18 of the spacer plate 13. As shown in FIG. 2, the respective outer ends 16*b* of the pressure chambers 16 of the two rows are open in only a lower surface of the cavity plate 14.

Figure 5:
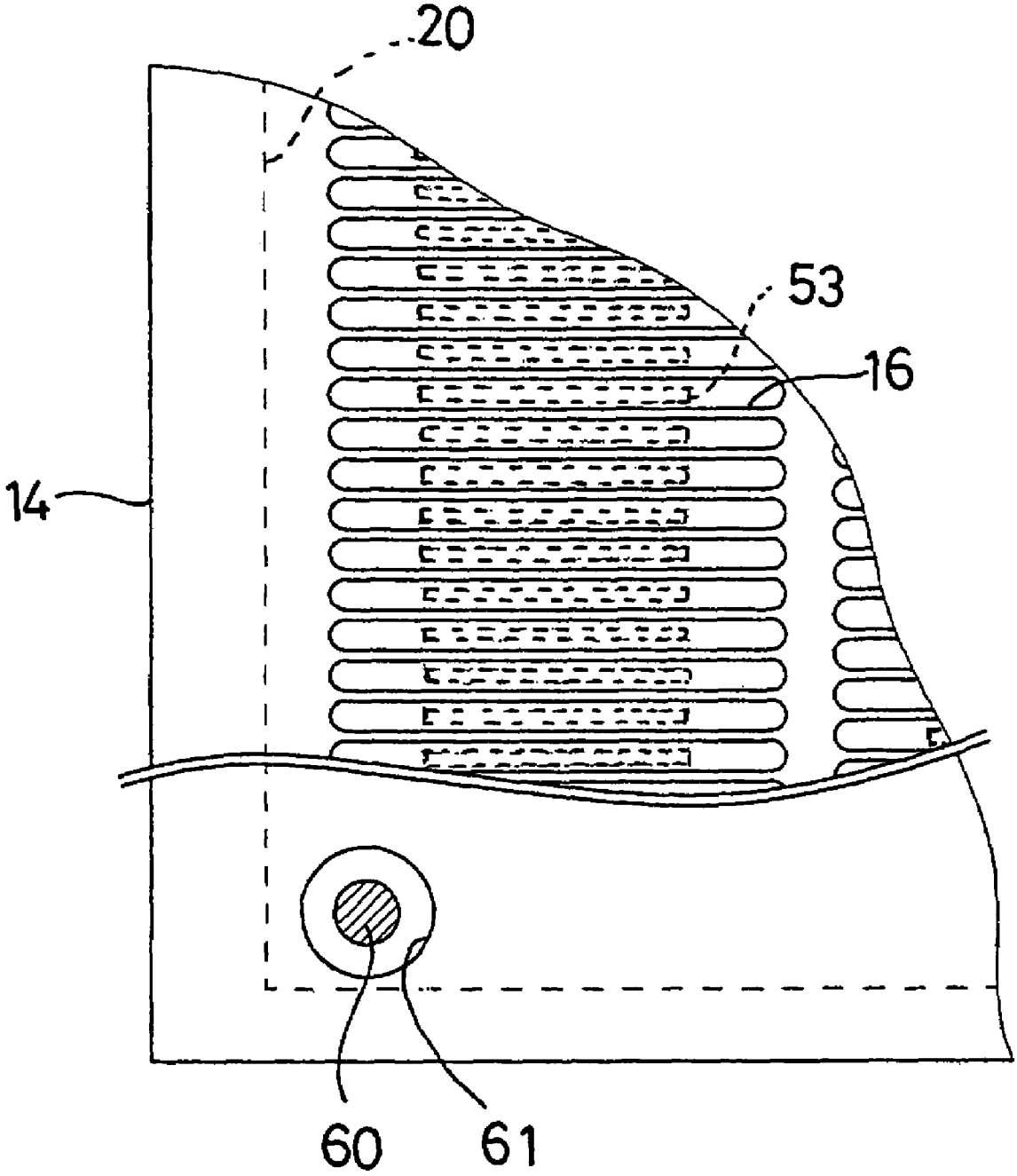
FIG. 5 is a fragmentary plan view for explaining positioning of the piezoelectric actuator and the cavity plate.

The cavity plate 14 is formed with openings 61 each of which permits a corresponding detect portion 60 provided on the piezoelectric actuator 20 (which will be described) to be perceived, upon stacking the piezoelectric actuator 20 and the cavity plate 14, as viewed from a cavity-plate side in a direction of stacking and each of which is aligned with the corresponding detect portion 60 for positioning the piezoelectric actuator 20 and the cavity plate 14 relative to each other. The openings 61 are formed in the cavity plate 14 so as to correspond to the respective detect portions 60 of the piezoelectric actuator 20. In the present embodiment, as shown in FIGS. 1 and 5, each opening 61 has a circular shape in plan view and has a diameter slightly larger than that of the detect portion 60.

As shown in FIG. 1, the cavity plate 14 has, at one of its longitudinally opposite end portions, two supply holes 19*a* which are formed through the thickness thereof while the spacer plate 13 has, at one of its longitudinally opposite end portions, two supply holes 19*b* which are formed through the thickness thereof. The two ink supply holes 19*a* formed in the cavity plate 14 are equipped with a filter 29 for removing dust and foreign matter from the ink supplied from ink tanks (not shown) provided above the cavity plate 14.

The ink supplied from the ink tanks to the two common ink chambers 12*a*, 12*b*; 12*a*, 12*b* via the supply holes 19*a*, 19*b* of the cavity plate 14 and the spacer plate 13 is distributed to the pressure chambers 16 via the respective through-holes 18, and then reach, via the through-holes 17, the nozzles 15 communicating with the respective pressure chambers 16.

Figure 3:
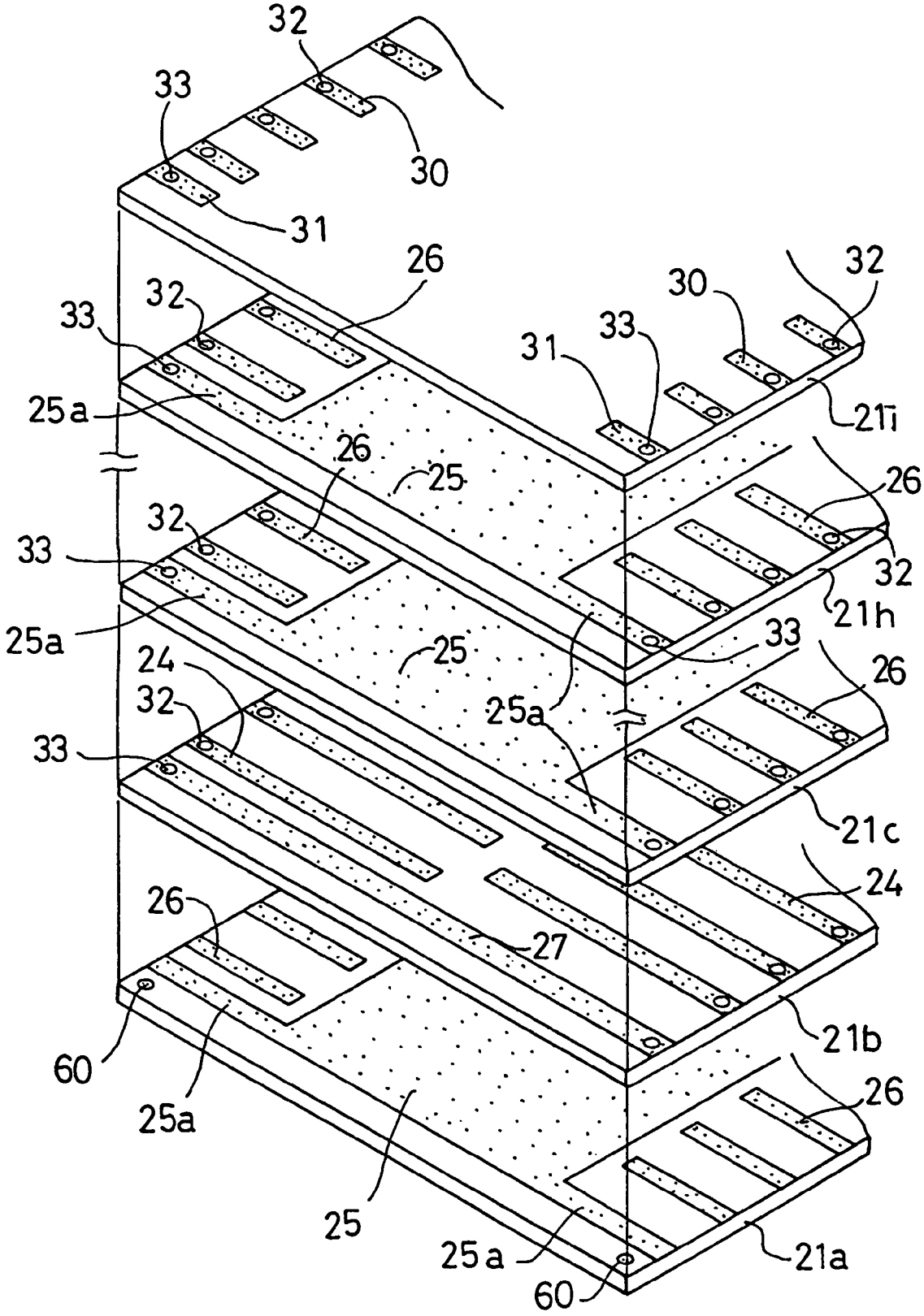
FIG. 3 is a fragmentary enlarged perspective view of a piezoelectric actuator.
Figure 4:
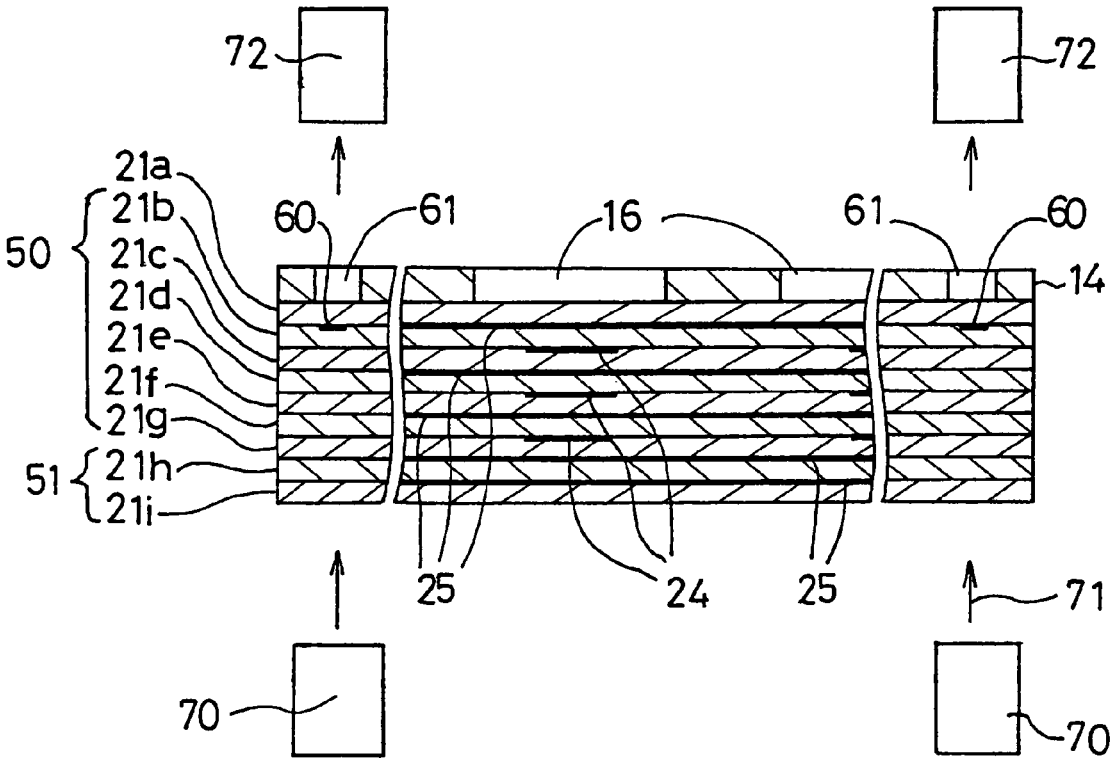
FIG. 4 is a fragmentary longitudinal cross sectional view of the cavity plate and the piezoelectric actuator for explaining positioning of the piezoelectric actuator and the cavity plate relative to each other.

The piezoelectric actuator 20 includes a plurality of piezoelectric layers and a plurality of electrode layers which are alternately stacked on each other. Each piezoelectric layer is provided by a piezoelectric sheet 21 formed of piezoelectric ceramic. In the present embodiment, the piezoelectric actuator 20 has a structure in which nine piezoelectric sheets 21*a*, 21*b*, 21*c*, 21*d*, 21*e*, 21*f*, 21*g*, 21*h*, 21*i* are stacked on one another, as shown in FIG. 4. The nine piezoelectric sheets 21 have a size substantially covering all of the pressure chambers 16 and have a same thickness. Each of the electrode layers is formed as an electrode pattern of a metal film formed on an upper major surface of a corresponding one of the nine piezoelectric sheets 21. It is noted that the upper and lower sides of the piezoelectric actuator 20 and the cavity plate 14 in FIGS. 1 and 3 are inverted in FIG. 4. Namely, the upper side of the piezoelectric actuator 20 is located at a lower portion in FIG. 4 while the lower side thereof is located at an upper portion in FIG. 4.

As shown in FIG. 4, the second through seventh piezoelectric sheets 21*b*, 21*c*, 21*d*, 21*e*, 21*f*, 21*g*, as counted from the lower side of the piezoelectric actuator 20 at which the piezoelectric actuator 20 is bonded to the cavity plate 14 (i.e., as counted in a downward direction from the cavity plate 14 in FIG. 4), cooperate with one another to provide an active layer 50 including a plurality of active portions 53 (FIG. 5) which respectively correspond to the plurality of pressure chambers 16 and each of which can be deformed, i.e., expanded and contracted to eject a droplet of ink from a corresponding one of the pressure chambers 16. The eighth and ninth piezoelectric sheets 21*h*, 21*i*, as counted from the lower side of the piezoelectric actuator 20 (as counted in the downward direction from the cavity plate 14 in FIG. 4), cooperate with each other to provide a restrictive layer 51 including a plurality of restricting portions which restrict upward deformations of the respective active portions 53 of the active layer 50, i.e., deformations of the active portions 53 in a direction away from the pressure chambers 16.

As shown in FIG. 3, on an upper surface of each of the second, fourth, and sixth piezoelectric sheets 21*b*, 21*d*, 21*f* as counted from the lower side of the piezoelectric actuator 20 (i.e., as counted in the downward direction from the cavity plate 14 in FIG. 4), there are provided, as an electrode pattern, a plurality of elongate strip-like individual electrodes 24 respectively corresponding to the plurality of pressure chambers 16 of the cavity plate 14. Described in detail, the individual electrodes 24 are arranged in two rows in a zigzag fashion in a first direction (i.e., a longitudinal direction) of the piezoelectric actuator 20 or the printing head 100. Each individual electrode 24 extends in a second direction perpendicular to the first direction to a position in the vicinity of a corresponding one of two long side edges of each of the piezoelectric sheets 21*b*, 21*d*, 21*f*.

In addition, as shown in FIG. 3, on an upper surface of each of the first, third, fifth, and seventh piezoelectric sheets 21*a*, 21*c*, 21*e*, 21*g* as counted from the lower side of the piezoelectric actuator 20 (i.e., as counted in the downward direction from the cavity plate 14 in FIG. 4), there is provided, as an electrode pattern, a common electrode 25 which is common to all of the pressure chambers 16.

In the present embodiment, as shown in FIGS. 4 and 5, each individual electrode 24 has a width slightly smaller than that of each pressure chamber 16. On the other hand, each common electrode 25 has, in its plan view, a rectangular shape which extends on a widthwise middle portion of the corresponding piezoelectric sheet in a longitudinal direction of the same 21*a*, 21*c*, 21*e*, 21*g*, such that each common electrode 25 extends over all of the pressure chambers 16 which are arranged on a widthwise middle portion of the cavity plate 14 in two rows in the first direction (i.e., longitudinal direction) of the cavity plate 14 or the printing head 100. Each common electrode 25 has lead portions 25*a*, 25*a* which are formed integrally with the common electrode 25 and which are respectively provided on the two longitudinally opposite end portions of each piezoelectric sheet 21*a*, 21*c*, 21*e*, 21*g*, such that the two lead portions 25*a*, 25*a* extend over respective entire lengths of the two longitudinally opposite end portions. At two widthwise opposite end portions along two long side edges of the upper surface of each piezoelectric sheet 21*a*, 21*c*, 21*e*, 21*g* on which the common electrode 25 and the lead portions 25*a*, 25*a* are not formed, there are provided dummy individual electrodes 26. The dummy individual electrodes 26 are formed in two rows so as to be aligned, in the direction of stacking of the piezoelectric sheets 21, with the respective two rows of the individual electrodes 24 formed on the piezoelectric sheets 21*b*, 21*d*, 21*f*. Each dummy individual electrode 26 has a width substantially equal to that of each individual electrode 24 and a length smaller than that of the same 24.

On the upper surface of the second, fourth, and sixth piezoelectric sheets 21*b*, 21*d*, 21*f*, there are provided two dummy common electrodes 27, 27 at respective two longitudinally opposite end portions of each sheet 21*b*, 21*d*, 21*f* which are aligned, in the direction of stacking of the piezoelectric sheets 21, with the two lead portions 25*a*, 25*a* of each common electrode 25.

As described above, each of the second through seventh piezoelectric sheets 21*b*, 21*c*, 21*d*, 21*e*, 21*f*, 21*g* is sandwiched by the individual electrodes 24 and the corresponding common electrodes 25. When the common electrodes 25 are grounded, as known in the art, via an electrically conductive material which fills through-holes (described below), and a positive high voltage for polarization is applied to all of the individual electrodes 24, respective portions of each piezoelectric sheet 21*b*, 21*c*, 21*d*, 21*e*, 21*f*, 21*g* which are sandwiched by the individual electrodes 24 and the common electrode 25 are polarized in a direction from the individual electrodes 24 toward the common electrode 25, so that the respective polarized portions provide the plurality of active portions 53 (FIG. 5). As known in the art, when the common electrodes 25 are grounded and a positive low voltage for driving the piezoelectric actuator 20 is selectively applied to one or more arbitrary individual electrodes 24, one or more corresponding active portions 53 deform, i.e., expand and contract owing to longitudinal piezoelectric effect.

The restrictive layer 51 is for restricting the deformation of each active portion 53 of the active layer 50 in the direction away from the corresponding pressure chamber 16. On an upper surface of the uppermost piezoelectric sheet 21*i* which is upper one of the two piezoelectric sheets 21*h*, 21*i* that constitute the restricting layer 51, there are provided two rows of individual surface electrodes 30 which extend along two long side edges of the piezoelectric sheet 21*i*, respectively, and which correspond to the two rows of the individual electrodes of each piezoelectric sheet 21*b*, 21*d*, 21*f*, and four common surface electrodes 31 which correspond to the common electrode 25. On the lower piezoelectric sheet 21*h* of the restrictive layer 51, there are provided dummy individual electrodes 26 connecting between the dummy individual electrodes 26 of the underlying sheet 21*g* and the individual surface electrodes 30 of the uppermost sheet 21*i* via the electrically conductive material filling through-holes 32 which will be described; two lead portions 25*a* connecting between the two lead portions 25*a* of the underlying sheet 21*g* and the common surface electrodes 31 of the upper most sheet 21*i* via the electrically conductive material filling through-holes 33 which will be described; and a common electrode 25 which is formed integrally with the two lead portions 25*a*. Since each of the piezoelectric sheets 21*h*, 21*i* of the restrictive layer 51 is not sandwiched by a common electrode 25 and individual electrodes 24, no portions of each sheet 21*h*, 21*i* are polarized when the polarizing voltage is applied to the piezoelectric actuator 20, or are deformed when the driving voltage is applied to the same 20. In general, it is not necessary to provide any electrode pattern, i.e., any electrodes on the sheet 21*h*. Nevertheless, the common electrode 25 is provided on the sheet 21*h* on the ground that there is a difference between a percentage of shrinkage upon firing of a piezoelectric sheet on which no electrodes are provided, and that of a piezoelectric sheet on which one or more electrodes are provided, thereby causing warpage or curving of the piezoelectric actuator 20 as a whole. To avoid this, the common electrode 25 is intentionally provided on the sheet 21*h*. If there is produced a potential difference between an electrode provided on the sheet 21*h* and another electrode which is opposed to that electrode of the sheet 21*h*, an electrostatic capacitance is produced. In view of this, the common electrode 25 which is identical with the common electrode 25 of the sheet 21*g* is provided on the sheet 21*h* to prevent the electrode 25 of the sheet 21*h* from adversely influencing the operation of the piezoelectric actuator 20.

Except for the lowermost piezoelectric sheet 21*a*, each of the piezoelectric sheets 21*b* through 21*i* has the through-holes 32 formed through the thickness thereof, so that each of the surface individual electrodes 30, and the individual electrodes 24 and the dummy individual electrodes 26, which electrodes 24, 26 are aligned with the corresponding surface individual electrodes 30 in the direction of stacking of the piezoelectric sheets 21, communicate with or are electrically connected to one another via the conductive material filling the through-holes 32. Similarly, except for the lowermost piezoelectric sheet 21*a*, each of the piezoelectric sheets 21*b* through 21*i* has the through-holes 33 formed through the thickness thereof, so that at least one of the four common surface electrodes 31 provided at respective portions in the vicinity of four corners of the uppermost sheet 21*i*, and the lead portions 25*a* of the common electrodes 25 and the dummy common electrodes 27, which lead portions 25*a* and the dummy common electrodes 27 are aligned with the at least one common surface electrode 31 in the direction of stacking of the piezoelectric sheets 21, communicate with or are electrically connected to one another via the conductive material filling the through-holes 33.

As shown in FIG. 3, the lowermost piezoelectric sheet 21*a* is provided with a plurality of detect portions 60 which are spaced apart from each other in its plan view and which are used for positioning the piezoelectric actuator 20 and the cavity plate 14 relative to each other. The detect portions 60 are formed of the same material as a material used for forming the electrodes and are marks patterned or formed concurrently when the common electrode 25 and the dummy individual electrodes 26 are formed on the piezoelectric sheet 21*a*. In the present embodiment, the detect portions 60 are provided at respective four corners of the sheet 21*a* and each detect portion 60 has a circular shape. Although the shape of the detect portions 60 is not particularly limited, the positions at which the respective detect portions 60 are formed are determined such that each detect portion 60 does not overlap any electrodes provided on other piezoelectric sheets 21*b* through 21*i*, in a plan view of the piezoelectric actuator 20, namely, as viewed in the direction of stacking of the piezoelectric sheets 21. In other words, there exist no electrodes above the detect portions 60. When the four detect portions 60 are aligned with the respective four openings 61 of the cavity plate 14, the active portions 53 of the piezoelectric actuator 20 and the pressure chambers 16 are respectively aligned with one another with high accuracy in the direction of stacking of the piezoelectric actuator 20 and the cavity plate 14, as shown in FIG. 5.

In producing the piezoelectric actuator 20, the through-holes 32, 33 are initially formed through the thickness of each of ceramic green sheets for the piezoelectric sheets 21*b* through 21*i*. Then, the electrode patterns (appropriate electrodes 24, 25, 25*a*, 26, 27, 30, 31) are formed by screen printing, for instance, on each green sheet for each piezoelectric sheet 21*a* through 21*i*, and the detect portions 60 are additionally formed by screen printing, for instance, on the green sheet for the piezoelectric sheet 21*a*. Simultaneously, the through-holes 32, 33 of each green sheet are filled with the electrically conductive material. Thereafter, the green sheets are stacked on one another such that each of the electrodes 24, 25*a*, 26, 27, 30, 31 is aligned with one or more corresponding through-holes 32, 33, and the stacked green sheets are fired as known in the art, to thereby provide the piezoelectric actuator 20.

The piezoelectric actuator 20 as a whole in which the plurality of piezoelectric sheets 21 are stacked on one another has a relatively small thickness, and is translucent after firing. Accordingly, when the piezoelectric actuator 20 is irradiated with a light applied thereto in the direction of stacking of the piezoelectric sheets 21, the shape of each detect portion 60 can be clearly projected toward the external, in other words, each detect portion 60 can be perceived from an outside of the piezoelectric actuator 20 since there exist no electrodes which interrupt the light that travels across the piezoelectric actuator 20 in the direction of stacking.

The flexible flat cable 40 has various wiring patterns, not shown, which are electrically connected to the individual and common surface electrodes 30, 31 of the piezoelectric actuator 20.

Next, there will be explained a method of producing the ink-jet printing head 100 having the structure described above.

Figure 6A:
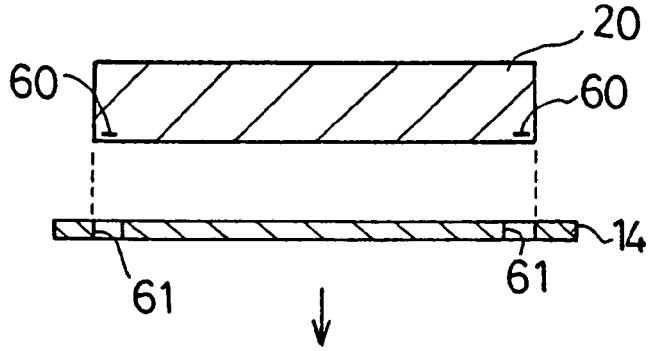
FIGS. 6A–6C are views for explaining process steps of manufacturing the ink-jet printing head.

Initially, the piezoelectric actuator 20 and the cavity plate 14 are superposed or stacked on each other, and interposed between a light source 70 and an image receiving device 72 such as a microscope, as shown in FIG. 4. Then, a light 71 which is emitted from the light source 70 is applied to the piezoelectric actuator 20 and the cavity plate 14 from a piezoelectric-actuator side in the direction of stacking of the actuator 20 and the cavity plate 14, and is received by the image receiving device 72 on a cavity-plate side in the direction of stacking. Since the inside diameter of each opening 61 of the cavity plate 14 is slightly larger than the outside diameter of each detect portion 61 of the actuator 20 as described above, the shadow of the detect portion 60 located in the opening 61 can be observed by the receiving device 72, as shown in FIG. 5. In other words, the image within the opening 61 can be observed by the receiving device 72 on the cavity-plate side in the direction of stacking. Thus, the detect portions 60 of the actuator 20 can be easily aligned with the respective openings 61 of the cavity plate 14. With the four detect portions 60 being properly aligned with the respective four openings 61 such that the entirety of each detect portion 60 is located within each opening 61, as shown in FIG. 6A, the actuator 20 and the cavity plate 14 are bonded and fixed to each other. Accordingly, the active portions 53 of the actuator 20 correspond to the pressure chambers 16 of the cavity plate 14, respectively, and one of opposite openings of each pressure chamber 16 is closed by the actuator 20. Thus, an integral body 80 in which the piezoelectric actuator 20 and the cavity plate 14 are bonded integrally to each other is obtained.

Since the openings 61 of the cavity plate 14 are kept open after the cavity plate 14 and the actuator 20 have been bonded to each other, it is possible to inspect that the detect portions 60 and the openings 61 are properly aligned with one another by using the light source 70 and image receiving device 72 after the actuator 20 and the cavity plate 14 have been bonded, in a manner similar to that conducted for positioning the actuator 20 and the cavity plate 14 relative to each other. Accordingly, if the integral body 80 is found to be defective due to misalignment of the detect portions 60 and the openings 61, i.e., due to improper positioning of the actuator 20 and the cavity plate 14 relative to each other, the defective integral body 80 is discarded before the following step is conducted.

Figure 6B:
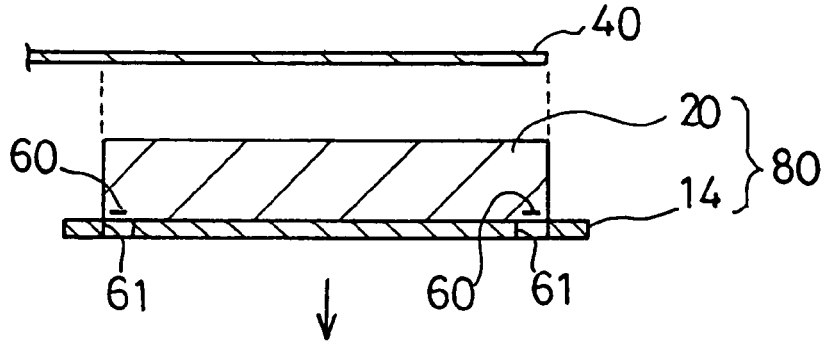

Next, as shown in FIG. 6B, the flexible flat cable 40 is bonded to an upper surface (back surface) of the integral body 80 which has been confirmed to be non-defective, such that the wiring patterns, not shown, of the flexible flat cable 40 accurately correspond to the surface electrodes 30, 31 of the actuator 20 for electrical connection therebetween. If some defects are found at this stage, the integral body 80 to which the flexible flat cable 40 has been bonded is discarded before the pre-unit 10 is bonded.

Figure 6C:
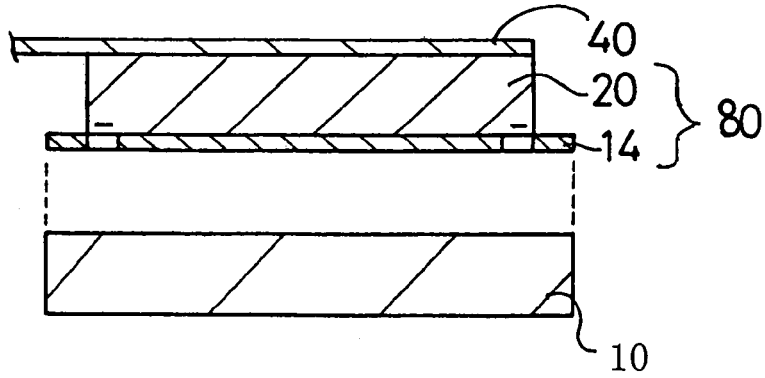

Subsequently, as shown in FIG. 6C, the pre-unit 10 is to the lower surface (front surface) of the integral body 80 which includes the pressure chambers 16 and to which the flexible flat cable 40 has been bonded, such that the pressure chambers 16 correspond to the nozzles 15, respectively. Thus, the pressure chambers 16 communicate with the respective nozzles 15 and the two common ink chambers 12*a*, 12*b*; 12*a*, 12*b*, and the other of the opposite openings of each pressure chamber 16 is closed by the pre-unit 10. The degree of accuracy with which the integral body 80 and the pre-unit 10 are positioned relative to each other is not so strict as compared with that with which the piezoelectric actuator 20 and the cavity plate 14 are positioned relative to each other. Since the cavity plate 14 and each of the plates 11, 12, 13 of the pre-unit 10 are formed of a metal, those plates are formed with high working accuracy as designed. Accordingly, the positioning of the pre-unit 10 and the integral body 80 including the pressure chambers 16 is conducted, for instance, by aligning respective outer peripheral portions of the cavity plate 14 and the pre-unit 10 with each other or by using a positioning jig.

In the illustrated embodiment, each opening 61 of the cavity plate 14 permits each detect portion 60 of the piezoelectric actuator 20 to be perceived, upon stacking the actuator 20 and the cavity plate 14, as viewed from the cavity-plate side in the direction of stacking. Accordingly, the piezoelectric actuator 20 and the cavity plate 14 are properly positioned relative to each other with the detect portions 60 being aligned with the respective openings 61. As described above, since the openings 61 of the cavity plate 14 are kept open and accordingly the detect portions 60 can be perceived from the cavity-plate side in the direction of stacking after the cavity plate 14 and the piezoelectric actuator 20 have been bonded to each other, it is possible to check or inspect, immediately after the cavity plate 14 and the actuator 20 have been bonded, that each detect portion 60 is properly aligned with the corresponding opening 61 so as to confirm whether the cavity plate 14 and the piezoelectric actuator 20 are properly positioned relative to each other. Hence, this arrangement permits the defects to be found in early stages of the manufacture of the printing head 100, e.g., prior to testing of the ink ejection performance, thereby improving a yield in the process steps to be conducted after the bonding of the actuator 20 and the cavity plate 14.

Upon confirming whether the cavity plate 14 and the actuator 20 are properly positioned relative to each other immediately after the bonding, it is possible to classify the integral bodies 80 having the pressure chambers into groups, depending upon the degree of accuracy of positioning. In this case, the pre-units 10 and the flexible flat cables 40 are also similarly ranked or divided into groups. One integral body 80 selected from a suitable group is bonded to one pre-unit 10 and one flexible flat cable 40 each selected from an appropriate group corresponding to the group to which that integral body 80 belongs.

Each detect portion 60 and each opening 61 are aligned with each other in the direction of stacking of the actuator 20 and the cavity plate 14, simplifying positioning of the actuator 20 and the cavity plate 14, as compared with a case wherein the positioning is conducted by utilizing marks provided on side surfaces of the actuator 20 and the cavity plate 14, for instance.

The flexible flat cable 40 is bonded to the piezoelectric actuator 20 (of the integral body 80) for supplying an electric power to selective electrodes of the actuator 20. Accordingly, the flexible flat cable 40 and the actuator 20 need to be positioned relative to each other with the most strict accuracy next to the positioning accuracy in positioning the cavity plate 14 and the piezoelectric actuator 20 relative to each other to align the pressure chambers 16 with the respective active portions 53. Accordingly, the defective ratio is relatively high in the bonding step of bonding the flexible flat cable 40 to the actuator 20. In view of this, in the present embodiment, the flexible flat cable 40 is bonded to the integral body 80 including the pressure chambers 16 before the pre-unit 10 is bonded to the integral body 80. According to this arrangement, when integral body 80 to which the flexible flat cable 40 has been bonded is found defective, the integral body 80 is removed or taken away from the production line. Since the pre-unit 10 is not yet bonded to the integral body 80 at this stage, the components of the pre-unit 10 are prevented from being wasted, reducing or minimizing the cost of components to be wasted.

In the illustrated embodiment, the plurality of detect portions 60 which are formed so as to be spaced apart from each other are aligned with the respective openings 61 for the relative positioning of the actuator 20 and the cavity plate 14, effectively increasing the positioning accuracy.

In the illustrated embodiment, the detect portions 60 are formed on the piezoelectric sheet 21*a* by using the same material as a material used for forming the electrodes concurrently when the common electrode 25, 25*a* and the dummy individual electrodes 26 are formed on the sheet 21*a*. This arrangement does not require a special or additional step for forming the detect portions 60, permitting easy formation of the same 60.

In the illustrated embodiment, the detect portions 60 are formed on the piezoelectric sheet 21*a* so as not to overlap, as viewed in the direction of stacking of the sheets 21, with the electrodes formed on the sheets 21 other than the sheet 21*a*. Since the piezoelectric sheets 21 after firing are translucent, the detect portions 60 can be projected toward the external by applying a light to the piezoelectric actuator 20 and the cavity plate 14 from the piezoelectric-actuator side in the direction of stacking the actuator 20 and the cavity plate 14. This arrangement permits easy alignment of the detect portions 60 with the corresponding openings 61.

Figure 7:
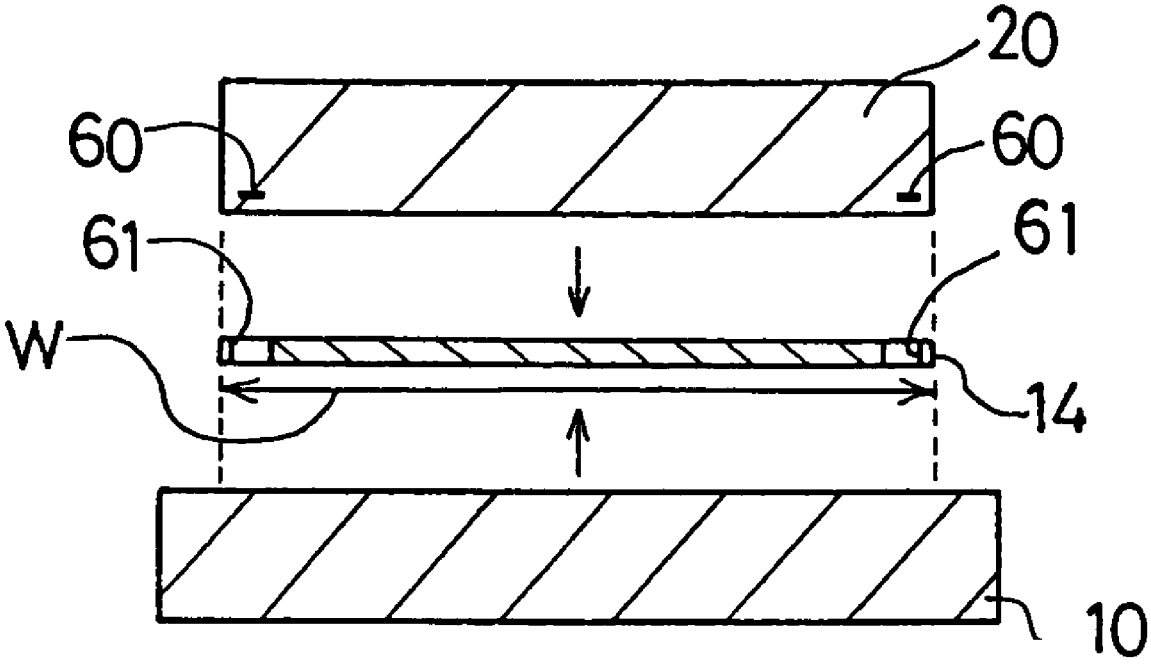
FIG. 7 is a cross sectional view showing a modification of the cavity plate.

In the present embodiment, the cavity plate 14 is formed as shown in FIG. 1 such that its shape is identical with that of the pre-unit 10 in their plan view. Since the cavity plate 14 is bonded to the piezoelectric actuator 20 before the pre-unit 10 is bonded to the cavity plate 14, the cavity plate 14 may have a shape corresponding to the actuator 20. For instance, the size of the cavity plate 14 may be made smaller than that of the pre-unit 10, as shown in FIG. 7. In FIG. 7, only the width dimension "W" of the cavity plate 14 is shown. Where the ink supply holes 19*a* of the cavity plate 14 shown in FIG. 1 are not provided and the supply holes 19*b* of the spacer plate 13 are equipped with the filter 29, the depth or longitudinal dimension, not shown, of the cavity plate 14 can be made smaller. In these cases, the number of the cavity plate 14 obtained from a blank can be increased if the size of the cavity plate 14 is made small.

In the method shown in FIGS. 6A through 6C, the flexible flat cable 40 is bonded to the integral body 80 having the pressure chambers prior to bonding of the pre-unit 10 to the integral body 80. As needed, the pre-unit 10 may be bonded to the integral body 80 before the flexible flat cable 40 is bonded to the integral body 80.

In the illustrated embodiment, the detect portions 60 are formed on the lowermost piezoelectric sheet 21*a*. The detect portions 60 may be formed on the piezoelectric sheet(s) other than the lowermost sheet 21*a* or on all piezoelectric sheets.

In the illustrated embodiment, the detect portions 60 are provided in the inside of the piezoelectric actuator 20. The detect portions 60 may be formed on the lower surface (front surface) of the actuator 20, for alignment with the openings 61 of the cavity plate 14. Further, markings provided on the outer side surface(s) of the piezoelectric actuator 20 may be aligned with markings provided on the upper surface (back surface) or the outer side surface(s) of the cavity plate 14.

While the preferred embodiments of the present invention have been described above, for illustrative purpose only, it is to be understood that the invention is not limited to the details of the illustrated embodiments, but may be embodied with various changes, modifications and improvements, which may occur to those skilled in the art, without departing from the spirit and scope of the invention.

What is claimed is:

1. A method of producing an ink-jet printing head which includes a plurality of nozzles, a plurality of pressure chambers which respectively correspond to the plurality of nozzles, at least one common ink chamber from which ink is supplied to the plurality of pressure chambers, a piezoelectric actuator which includes a plurality of active portions respectively corresponding to the plurality of pressure chambers, the method comprising the steps of:

a pre-unit forming step of forming a pre-unit in which the plurality of nozzles and the at least one common ink chamber are formed;

a pressure-chamber forming step of forming the plurality of pressure chambers in a cavity plate through the thickness thereof;

a piezoelectric-actuator forming step of forming the piezoelectric actuator by stacking a plurality of piezoelectric sheets each having a size substantially covering the plurality of pressure chambers, with at least one electrode being interposed between adjacent two of the plurality of piezoelectric sheets, so that portions of the plurality of piezoelectric sheets sandwiched by the electrodes function as the plurality of active portions;

an integral-body forming step of forming an integral body including the plurality of pressure chambers by stacking and bonding the piezoelectric actuator and the cavity plate such that the plurality of active portions respectively correspond to the plurality of pressure chambers and such that one of opposite openings of each of the plurality of pressure chambers is closed by the piezoelectric actuator;

an integral-body bonding step of bonding the integral body which includes the plurality of pressure chambers to the pre-unit, such that the plurality of pressure chambers respectively communicate with the plurality of nozzles and the at least one common ink chamber and such that the other of the opposite openings of each of the plurality of pressure chambers is closed by the pre-unit;

a detect-portion forming step of forming at the piezoelectric actuator at least one detect portion which can be perceived from an outside of the piezoelectric actuator and which is used for positioning the piezoelectric actuator and the cavity plate relative to each other; and an opening forming step of forming in the cavity plate at least one opening through the thickness thereof each of which permits each of the at least one detect portion to be perceived, upon stacking the piezoelectric actuator and the cavity plate, as viewed from a cavity-plate side in a direction of stacking and each of which is aligned with each of the at least one detect portion of the piezoelectric actuator for positioning the piezoelectric actuator and the cavity plate relative to each other.

2. The method according to claim 1, wherein the detect-portion forming step comprises forming a plurality of detect portions at the piezoelectric actuator so as to be spaced apart from each other as viewed in the direction of stacking.

3. The method according to claim 1, wherein the piezoelectric-actuator forming step comprises forming the at least one electrode on at least one of opposite surfaces of at least one piezoelectric sheet and the detect-portion forming step comprises forming, by using the same material as a material used for forming the at least one electrode, the at least one detect portion on the at least one piezoelectric sheet concurrently when the at least one electrode is formed.

4. The method according to claim 3, wherein the at least one detect portion is formed on the at least one piezoelectric sheet so as not to overlap, as viewed in the direction of stacking, with the electrodes which are formed respectively in the plurality of piezoelectric sheets other than the at least one piezoelectric sheet on which the at least one detect portion is formed.

5. The method according to claim 1, further comprising:

a positioning step of positioning the piezoelectric actuator and the cavity plate relative to each other such that the entirety of each of the at least one detect portion is located within each of the at least one opening as viewed from the cavity-plate side in the direction of stacking, the positioning step being conducted prior to the integral-body forming step.

6. The method according to claim 5, wherein the positioning step comprises applying a light to the piezoelectric actuator and the cavity plate from a piezoelectric-actuator side in the direction of stacking which is opposite to the cavity-plate side and observing an image within each of the at least one opening on the cavity-plate side in the direction of stacking, so that the piezoelectric actuator and the cavity plate are positioned relative to each other on the basis of the image.

7. A method of producing an ink-jet printing head which includes a plurality of nozzles, a plurality of pressure chambers which respectively correspond to the plurality of nozzles, at least one common ink chamber from which ink is supplied to the plurality of pressure chambers, a piezoelectric actuator which includes a plurality of active portions respectively corresponding to the plurality of pressure chambers, the method comprising the steps of:

a pre-unit forming step of forming a pre-unit in which the plurality of nozzles and the at least one common ink chamber are formed;

a pressure-chamber forming step of forming the plurality of pressure chambers in a cavity plate through the thickness thereof;

a piezoelectric-actuator forming step of forming the piezoelectric actuator by stacking a plurality of piezoelectric sheets each having a size substantially covering the plurality of pressure chambers, with at least one electrode being interposed between adjacent two of the plurality of piezoelectric sheets, so that portions of the plurality of piezoelectric sheets sandwiched by the electrodes function as the plurality of active portions;

an integral-body forming step of forming an integral body including the plurality of pressure chambers by stacking and bonding the piezoelectric actuator and the cavity plate such that the plurality of active portions respectively correspond to the plurality of pressure chambers and such that one of opposite openings of each of the plurality of pressure chambers is closed by the piezoelectric actuator; and an integral-body bonding step of bonding the integral body which includes the plurality of pressure chambers to the pre-unit, such that the plurality of pressure chambers respectively communicate with the plurality of nozzles and the at least one common ink chamber and such that the other of the opposite openings of each of the plurality of pressure chambers is closed by the pre-unit, and an inspection step of inspecting that the piezoelectric actuator and the cavity plate are properly positioned relative to each other, the inspection step being conducted before the integral-body bonding step.

8. A method of producing an ink-jet printing head which includes a plurality of nozzles, a plurality of pressure chambers which respectively correspond to the plurality of nozzles, at least one common ink chamber from which ink is supplied to the plurality of pressure chambers, a piezoelectric actuator which includes a plurality of active portions respectively corresponding to the plurality of pressure chambers, the method comprising the steps of:

a pre-unit forming step of forming a pre-unit in which the plurality of nozzles and the at least one common ink chamber are formed;

a pressure-chamber forming step of forming the plurality of pressure chambers in a cavity plate through the thickness thereof;

a piezoelectric-actuator forming step of forming the piezoelectric actuator by stacking a plurality of piezoelectric sheets each having a size substantially covering the plurality of pressure chambers, with at least one electrode being interposed between adjacent two of the plurality of piezoelectric sheets, so that portions of the plurality of piezoelectric sheets sandwiched by the electrodes function as the plurality of active portions;

an integral-body forming step of forming an integral body including the plurality of pressure chambers by stacking and bonding the piezoelectric actuator and the cavity plate such that the plurality of active portions respectively correspond to the plurality of pressure chambers and such that one of opposite openings of each of the plurality of pressure chambers is closed by the piezoelectric actuator; and an integral-body bonding step of bonding the integral body which includes the plurality of pressure chambers to the pre-unit, such that the plurality of pressure chambers respectively communicate with the plurality of nozzles and the at least one common ink chamber and such that the other of the opposite openings of each of the plurality of pressure chambers is closed by the pre-unit, and a flexible-flat-cable bonding step of bonding a flexible flat cable to the integral body which includes the plurality of pressure chambers, the flexible flat cable being for supplying an electric power to the electrodes of the piezoelectric actuator, the flexible-flat-cable bonding step being conducted after the integral-body forming step and prior to the integral-body bonding step.

* * * * *